US007793925B2

(12) United States Patent
Tokuno

(10) Patent No.: US 7,793,925 B2
(45) Date of Patent: Sep. 14, 2010

(54) SHEET LOADING DEVICE

(75) Inventor: Yoshiaki Tokuno, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 321 days.

(21) Appl. No.: 11/873,806

(22) Filed: Oct. 17, 2007

(65) Prior Publication Data

US 2009/0102111 A1 Apr. 23, 2009

(51) Int. Cl.
*B65H 39/00* (2006.01)

(52) U.S. Cl. ..... 270/58.09; 270/58.07; 270/58.11

(58) Field of Classification Search ..... 270/58.04, 270/58.07, 58.09, 58.11
See application file for complete search history.

(56) References Cited

U.S. PATENT DOCUMENTS 6,209,864 B1 * 4/2001 Taniguchi et al. ..... 271/220
6,601,846 B2 * 8/2003 Saito et al. ..... 271/226
2005/0121848 A1 * 6/2005 Kodama et al. ..... 270/58.12
2008/0315489 A1 * 12/2008 Iguchi et al. ..... 270/37
2009/0072465 A1 * 3/2009 Iguchi et al. ..... 270/37

FOREIGN PATENT DOCUMENTS

JP 11-060023 3/1999

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

There is provided a technique which can realize stable loading performance irrespective of the state of a loaded object loaded on a tray. A loading information acquisition unit 106 acquires loading information relating to a sheet loading height on a loading tray 101 on which a sheet subjected to a specified processing is loaded, and a press force adjusting unit 107 moves, based on the loading information, at least one of the loading tray 101 and a pressing unit 104 to press from above the sheet loaded on the loading tray in a direction in which the loading tray and the pressing unit 104 are distanced from each other.

10 Claims, 9 Drawing Sheets

SHEET LOADING DEVICE

BACKGROUND OF THE INVENTION

1. Field of the Invention

The present invention relates to an improvement of sheet loading performance in a sheet loading device on which a sheet subjected to a specified processing is loaded.

2. Description of the Related Art

Hitherto, there is known a post-processing apparatus which can perform post-processing, such as staple processing or simple bookbinding processing, on a sheet subjected to print processing in an image forming apparatus. The post-processing apparatus includes a sheet loading device which discharges the sheet subjected to the foregoing specified post-processing to the outside of the apparatus and is for loading the discharged processed sheet.

In the related art sheet loading device, in order to enable more processed sheets to be loaded on a loading tray, following contrivances are made.

(1) A structure is made such that an inclined surface with a fixed inclined angle is provided on the loading surface of the loading tray, and the processed sheet discharged from the post-processing apparatus slides down along the inclined surface to the front end of the inclined tray.

(2) In order to downward press the center portion of the processed sheet loaded on the loading tray and to lower the loading height of the sheet loaded on the loading tray (to ensure an interval between a sheet discharge port in the post-processing apparatus and the sheet upper surface on the loading tray), a pressing member is provided above the loading tray.

In the related art loading device, the loadable number of sheets is set according to the size of a processed sheet, the number of bound sheets and the like, and when the number of sheets loaded on the loading tray exceeds the loadable number of sheets, a full-loading state signal is sent to the image forming apparatus.

In the related art sheet loading device, there is a fear that disadvantages as described below occur.

In general, the center portion of a booklet to which a simple bookbinding processing has been performed by the post-processing apparatus often expands. Thus, when many booklets are loaded on the loading tray, the expansions of the center portions of the booklets overlap with each other, press force at a contact position between the pressing member and the upper surface of the loaded booklet is increased, and the transport load of a next discharged booklet at the time of discharging onto the loading tray is remarkably increased. FIG. 9 is a view showing an example of poor sheet discharging caused by the increase of the transport load due to the overlap of the expansions of the booklet center portions in the related art post-processing apparatus.

In the case where a sheet (A3/LD, etc.) having a large size in the sheet transport direction is discharged from the post-processing apparatus, when the discharged sheet passes through the contact position between the pressing member and the upper surface of the loaded booklet, since it is sent in a state where the rear edge of the booklet is nipped by discharge rollers, stable sheet discharge (transport onto the loading tray) is performed. On the other hand, with respect to a sheet (LG, etc.) in which the size in the sheet transport direction is small, there is a case where after the sheet is discharged by the discharge rollers, the leading edge of the sheet is stopped by the load at the contact position between the pressing member and the upper surface of the loaded booklet, and can not be transported to a desired position on the loading tray. When the poor transport is repeated, the rear edge of the sheet discharged from the post-processing apparatus eventually blocks a sheet discharge port of the post-processing apparatus, and the poor sheet discharging is caused.

In the related art sheet loading device, in the case where the poor sheet discharging occurs, parameters, such as the size, the number of bound sheets and the number of loaded sheets, in which the poor sheet discharging occurs are confirmed, and the specifications are reviewed so that the full-loading state signal is transmitted to the image forming apparatus before reaching the initially set number of loaded sheets.

SUMMARY OF THE INVENTION

It is an object of an embodiment of the invention to provide a technique which can realize stable loading performance irrespective of a state of a loaded object loaded on a tray.

In order to solve the problem, according to an aspect of the invention, a sheet loading device includes a loading information acquisition unit configured to acquire loading information relating to a sheet loading height on a loading tray on which a sheet subjected to a specified processing is loaded, and a press force adjusting unit configured to move, based on the loading information, at least one of the loading tray and a pressing unit to press from above the sheet loaded on the loading tray in a direction in which the loading tray and the pressing unit are distanced from each other.

Besides, according to another aspect of the invention, a sheet loading device includes a loading tray on which a sheet subjected to a specified processing is loaded, a pressing member to press from above the sheet loaded on the loading tray, and an elastic support unit configured to support the loading tray while applying an elastic force in a direction in which the loading tray approaches the pressing member, and to support the loading tray to allow the loading tray to be movable in a direction of moving away from the pressing member against the elastic force by a weight of the sheet loaded on the loading tray.

Besides, according to another aspect of the invention, a sheet loading device includes a loading tray on which a sheet subjected to a specified processing is loaded, pressing means for pressing from above the sheet loaded on the loading tray, and elastic support means for supporting the loading tray while applying an elastic force in a direction in which the loading tray approaches the pressing means, and for supporting the loading tray to allow the loading tray to be movable in a direction of moving away from the pressing means against the elastic force by a weight of the sheet loaded on the loading tray.

DESCRIPTION OF THE EMBODIMENTS

Hereinafter, embodiments of the invention will be described with reference to the drawings.

First Embodiment

First, a first embodiment of the invention will be described.

Figure 1:
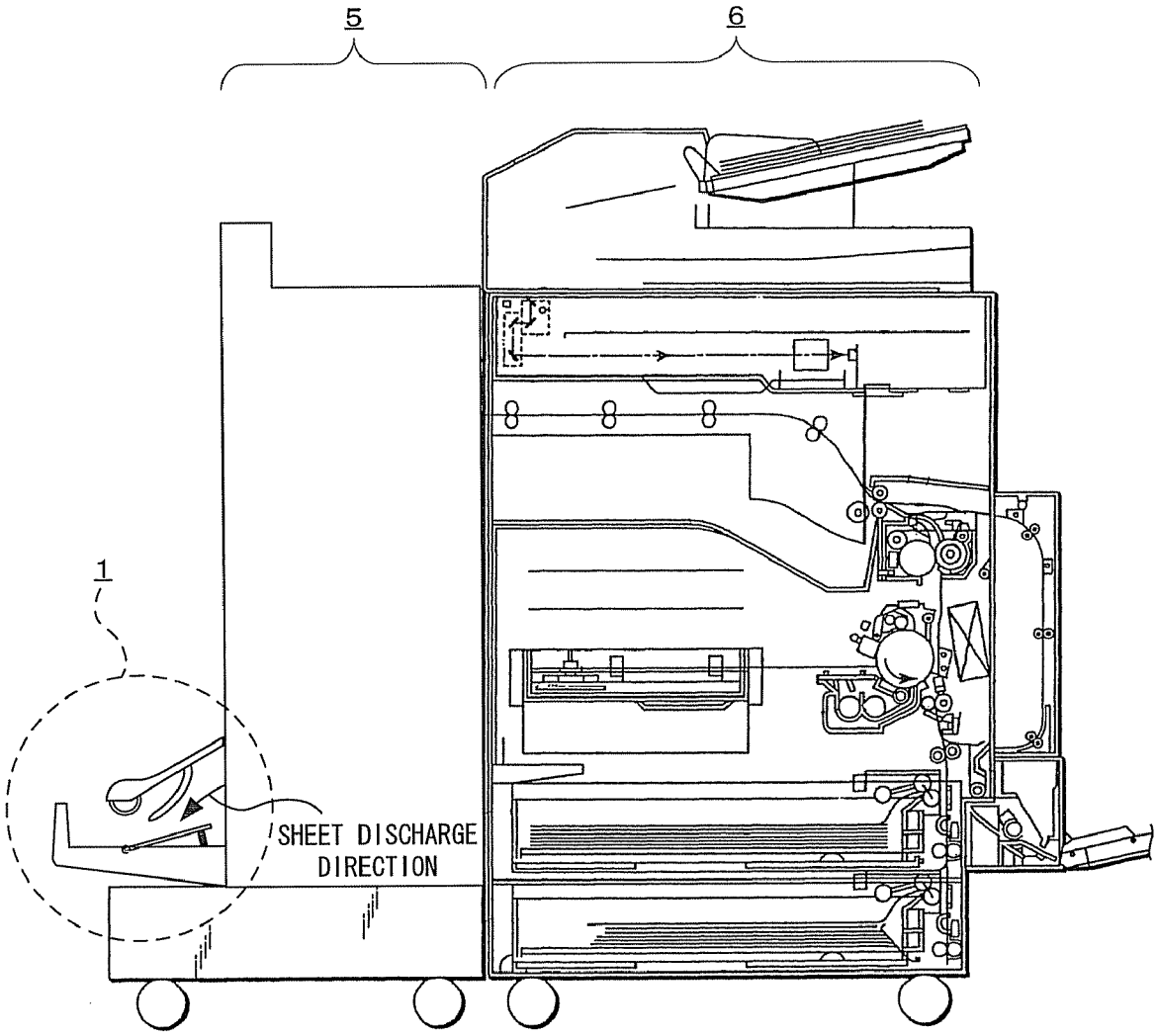
FIG. 1 is a view for explaining an image processing apparatus including a sheet loading device of a first embodiment of the invention.

FIG. 1 is a view for explaining an image processing apparatus including a sheet loading device of a first embodiment of the invention.

The image processing apparatus of the embodiment includes an image forming device 6 to form a desired image on a sheet, a post-processing device 5 to perform a specified post-processing on the sheet subjected to the specified image forming processing in the image forming device 6, and a sheet loading device 1 to load the sheet, which is subjected to the processing by at least one of the image forming device 6 and the post-processing device 5 and is discharged from the post-processing device 5, onto a loading tray. The post-processing device 5 can perform, as the specified post-processing, for example, "staple processing" in which a sheet bundle is stapled and bound, "simple bookbinding processing" in which a sheet bundle including plural sheets is bent at the center position and is stapled to form one booklet, "punch processing" in which a punch hole is provided at a desired position of a sheet, and the like.

Specifically, the image processing apparatus of the embodiment can be realized by, for example, an MFP (Multi Function Peripheral) or the like.

Figure 2:
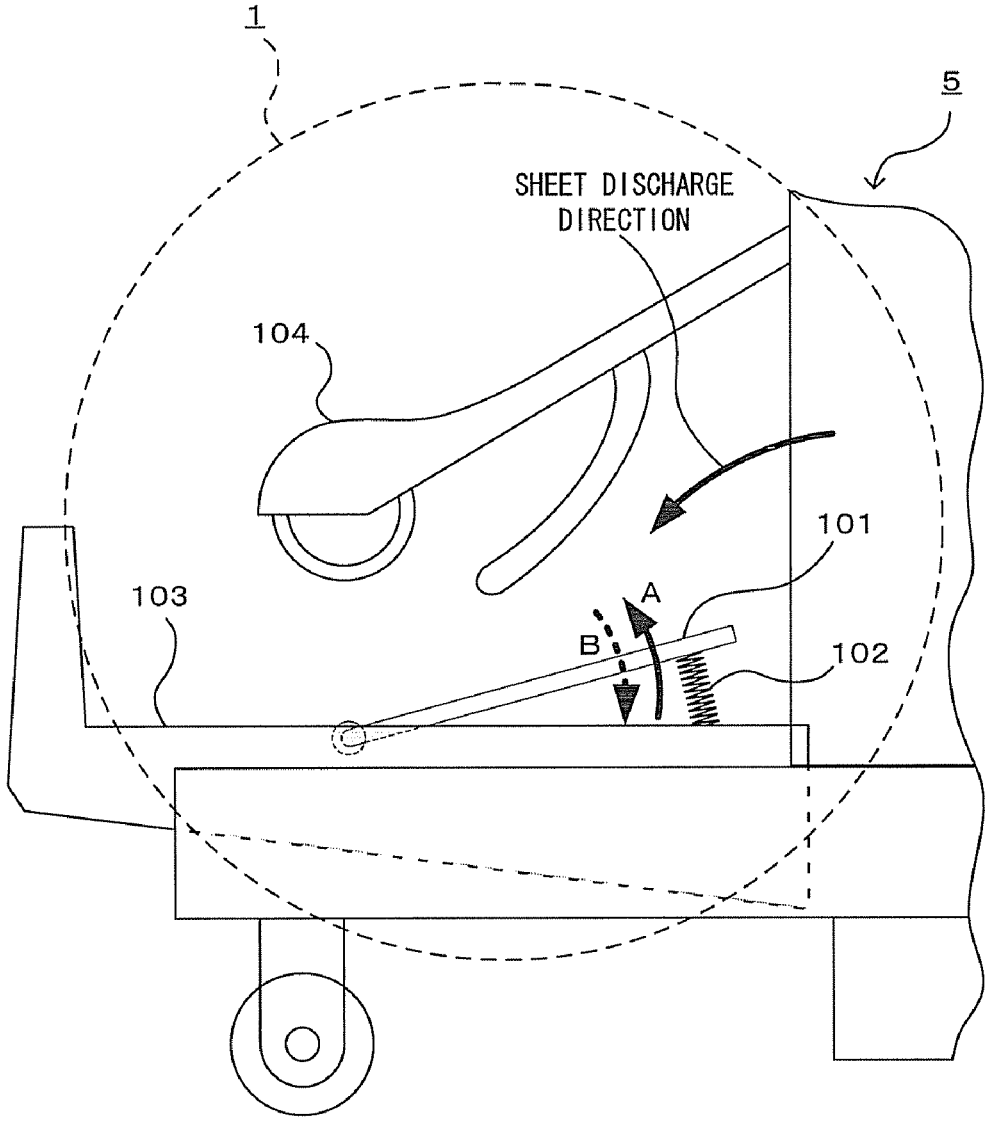
FIG. 2 is a view showing a specific structure of the sheet loading device 1 of the first embodiment of the invention.

FIG. 2 is a view showing a specific structure of the sheet loading device 1 of the first embodiment of the invention.

As shown in FIG. 2, the sheet loading device 1 of the embodiment includes a loading tray 101, a spring (elastic body) 102, a tray base 103 and a pressing unit 104.

A sheet subjected to a specified processing in at least one of the image forming device 6 and the post-processing device 5 is loaded on the loading tray 101.

The pressing unit (pressing member, pressing means) 104 is provided above the loading tray 101, and presses from above the upper surface of the sheet loaded on the loading tray 101. By this, even in the case where a booklet having an expansion is loaded on the loading tray 101, the expansion is pressed from above, so that the loading height on the loading tray 101 can be kept low. Besides, the pressing unit 104 also has a role as a transport guide to guide the sheet discharged from the post-processing device 5 onto the loading surface of the loading tray 101.

The elastic support unit (elastic support means) supports the loading tray 101 while applying an elastic force by the spring 102 in a direction (A direction) in which the loading tray approaches the pressing unit 104. Besides, the elastic support unit supports the loading tray 101 to allow the loading tray to be movable in a direction of moving away from the pressing unit 104 against the elastic force by the weight of the sheet loaded on the loading tray 101.

Specifically, the elastic support unit includes, for example, the spring 102 and a support part to rotatably support the downstream side end of the loading tray 101 in a direction in which the sheet is transported onto the loading tray 101. By supporting the loading tray 101 as stated above, an inclined surface can be formed in the state in which elastic urging is performed by the spring 102.

By adopting the structure as stated above, the sheet discharged from the post-processing device 5 onto the loading tray 101 can be guided smoothly to a collision part (stopper) at the end of the loading tray 101 while being slid to the downstream side in the transport direction by the inclined surface of the loading tray 101.

The inclined angle of the loading tray 101 is set to become large when the loading amount on the loading tray 101 is small, and is set to become small when the loading amount is large. By this, it is avoided that when the loading amount on the loading tray 101 is large, the contact pressure at the contact position between the pressing unit 104 and the upper surface of the expanded loaded booklet is increased. Besides, in the case where the loaded object is a booklet, since the expansion of the upper surface has an inclined shape, the inclined angle of the loading tray 101 itself may be small.

Figure 3:
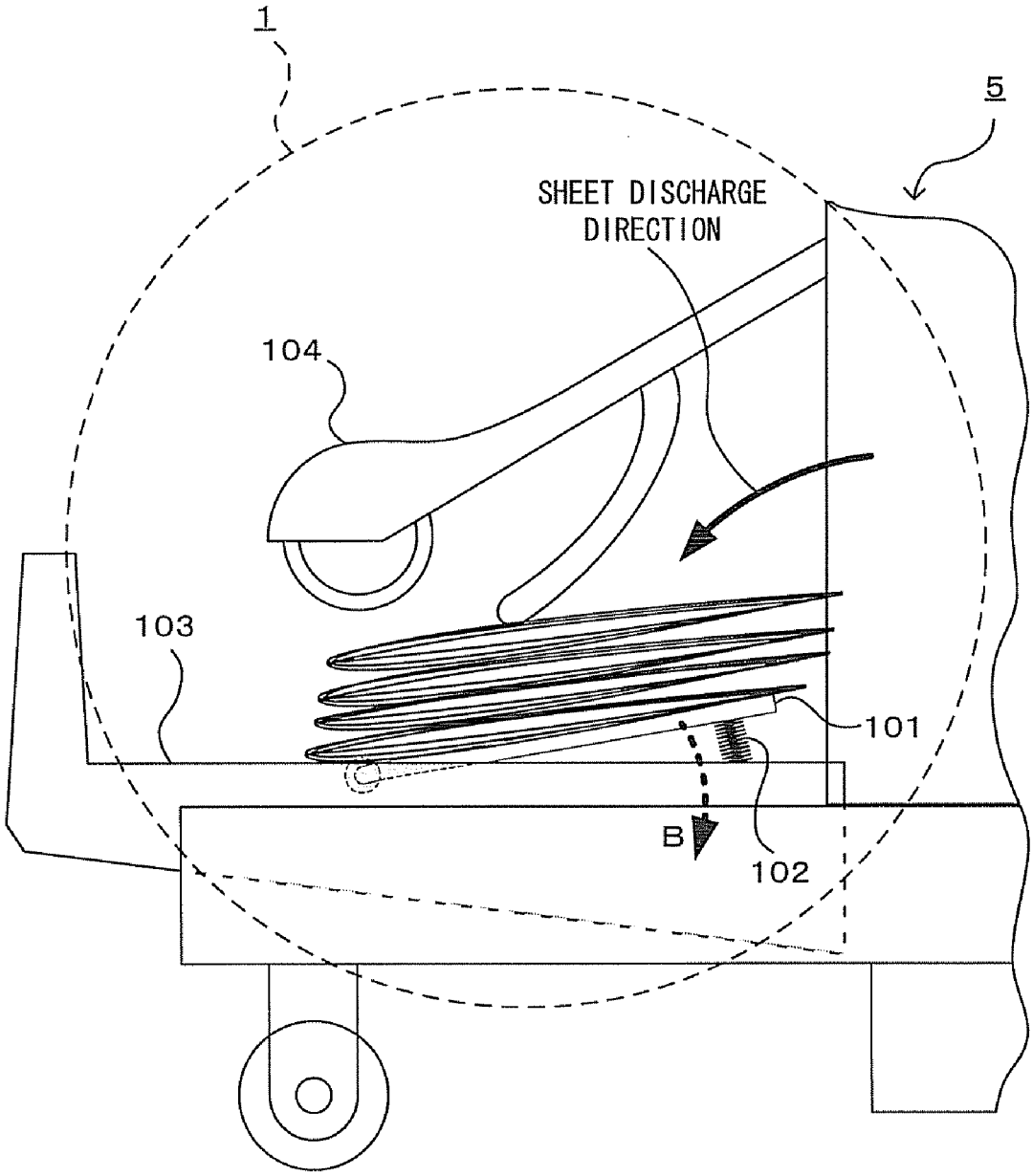
FIG. 3 is a view showing a state in which plural booklets simply bound by a post-processing device 5 are loaded on a loading tray 101 of the sheet loading device 1 of the first embodiment of the invention.

FIG. 3 is a view showing a state in which plural booklets simply bound by the post-processing device 5 are loaded on the loading tray 101 of the sheet loading device 1 of the first embodiment of the invention. As shown, as the number of booklets loaded on the loading tray 101 becomes large, the weight applied to the loading tray becomes large, and with the increase of the loading weight, the loading tray 101 is rotated in a B direction around a support shaft, and the inclined angle of the loading tray 101 becomes gentle (the loading surface of the loading tray 101 moves away from the pressing unit 104).

Second Embodiment

Next, a second embodiment of the invention will be described.

Figure 4:
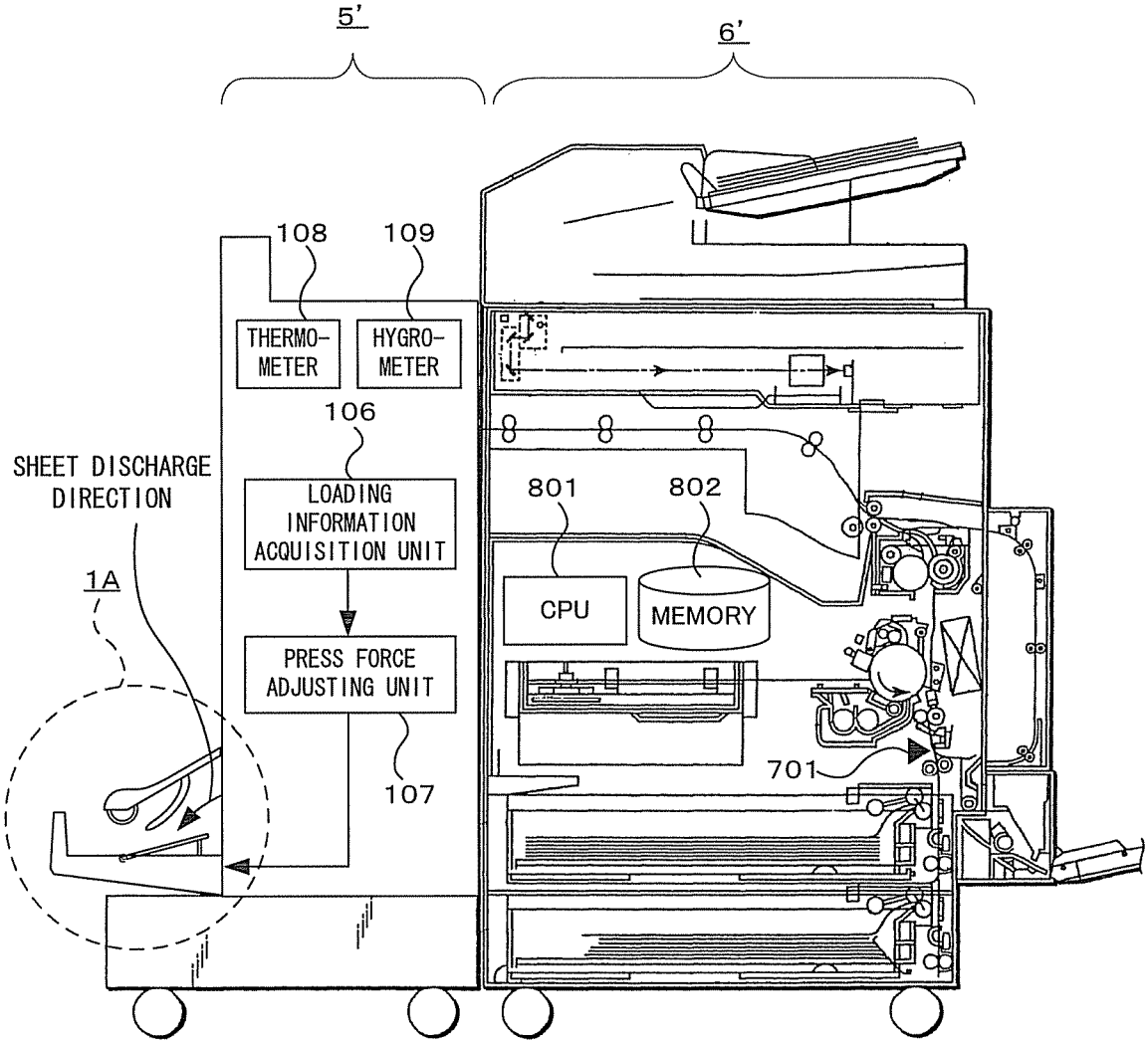
FIG. 4 is a view showing a rough structure of an image processing apparatus including a sheet loading device 1A of a second embodiment of the invention.

FIG. 4 is a view showing a rough structure of an image processing apparatus including a sheet loading device 1A of the second embodiment of the invention. Hereinafter, a portion having the same function as a portion already explained in the first embodiment is denoted by the same reference numeral and its explanation will be omitted.

The image processing apparatus of the embodiment includes a sheet loading device 1A, an image forming device 6', and a post-processing device 5'.

Specifically, the post-processing device 5' of the embodiment includes a loading information acquisition unit 106, a press force adjusting unit 107, a thermometer 108, and a hygrometer 109.

The loading information acquisition unit 106 acquires "loading information" relating to the loading height of sheets on a loading tray 101 on which sheets subjected to a specified processing in the image forming device 6' or the post-processing device 5' are loaded.

The press force adjusting unit 107 controls, based on the loading information acquired by the loading information acquisition unit 106, so as to move at least one of the loading tray 101 and a pressing unit 104 to press from above the sheet loaded on the loading tray 101 in a direction in which the loading tray 101 and the pressing unit 104 are distanced from each other.

The image forming device 6' of the embodiment includes a CPU 801, a memory 802 and a media sensor 701. The media sensor 701 can detect, for example, the thickness of a sheet as a processing object in the image forming device 6', the surface roughness value, the reflectivity, the paper quality, and the like.

The CPU 801 has a role to perform various processings in the sheet loading device 1, and also has a role to realize various functions by executing programs stored in the memory 802. The memory 802 includes, for example, a ROM, a RAM and the like, and has a role to store various information and programs used in the sheet loading device 1.

Incidentally, it is not always necessary that the loading information acquisition unit 106, the press force adjusting unit 107, the thermometer 108, the hygrometer 109 and the media sensor 701 are arranged at positions shown in the embodiment, and when the respective components are arranged so as to be capable of performing the functions consequently, they may be arranged in any of the sheet loading device 1A, the post-processing device 5' and the image forming device 6'.

Here, information acquired by the loading information acquisition unit 106 includes, for example, (1) the number of sheets subjected to the specified processing, (2) the period of time in which the specified processing is performed to the sheet to be loaded on the loading tray, (3) the number of bound booklets to be loaded on the loading tray, (4) the number of sheets bound into one booklet in the specified processing, (5) the surface roughness value of the sheet as the object of the specified processing, (6) temperature, and (7) humidity.

Specifically, among the above information, (1) and (2) are acquired from, for example, the post-processing device 5' or the image processing device 6'. Besides, (3) and (4) are acquired from, for example, the post-processing device 5'. Besides, with respect to (5), a detected value in the media sensor 701 is acquired. Besides, with respect to (6) and (7), detected values in the thermometer 108 and the hygrometer 109 arranged in the post-processing device 5' are acquired.

Figure 5:
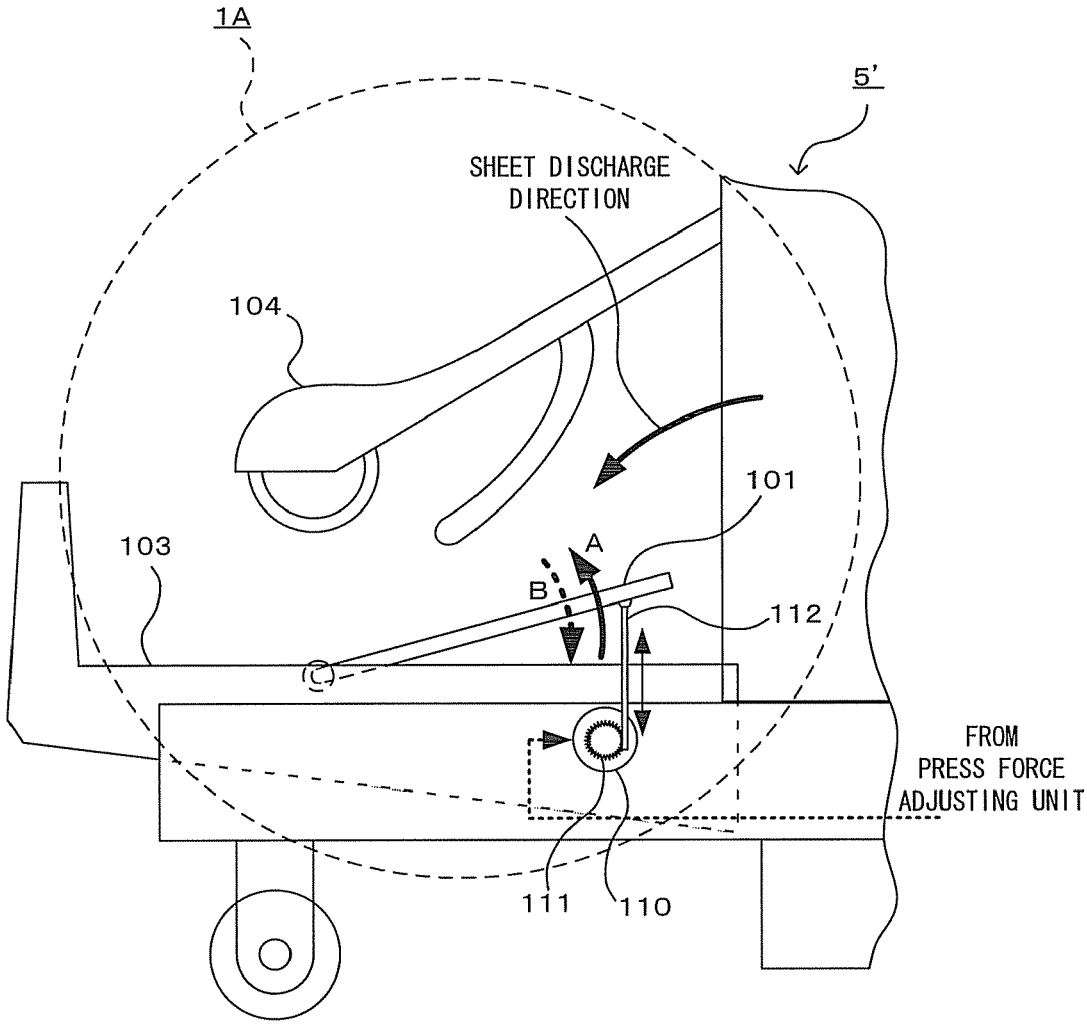
FIG. 5 is a view showing a detailed structure of the sheet loading device 1A of the second embodiment of the invention.

FIG. 5 is a view showing a detailed structure of the sheet loading device 1A of the second embodiment of the invention.

As shown in the drawing, the sheet loading device 1A of the embodiment includes a loading tray 101, a tray base 103, a pressing unit 104, a motor 110, a pinion 111 and a rack 112.

By the structure as stated above, the tray base 103 and the loading tray 101 are made different members, and by using the pinion 111 and the rack 112 driven by the motor 110, the inclination angle of the loading tray 101 can be changed stepwise (or non-stepwise (continuously)) according to the loading information.

Besides, the press force applied to the sheet loaded on the loading tray 101 can be adjusted according to the sheet loading height, and it is possible to suppress the occurrence of a problem, such as poor sheet discharging, caused by the press force of the pressing unit 104 to the sheet, which becomes large with the increase of the loading height. By this, the loading property of the sheet on the loading tray 101 can be made more stable.

Incidentally, it is preferable that as the surface roughness value of the sheet as the object of the specified processing becomes high, the press force adjusting unit 107 of the embodiment advances the timing when the movement of at least one of the loading tray 101 and the pressing unit 104 is started.

In general, as the surface roughness value of the sheet to be loaded on the loading tray becomes high, it becomes hard for the sheet loaded on the loading tray to slide on adjacent sheet, and the sheet discharge onto the loading tray is liable to clog (sheet transport resistance onto the loading tray is liable to increase).

Thus, in the case where the sheet having such characteristics is loaded, the occurrence of the poor sheet discharging is suppressed by advancing the timing when the press force of the pressing unit 104 is weakened (the pressing unit 104 starts to be moved away from the loading tray 101).

Besides, it is desirable that as the printing ratio on the sheet in the image forming device 6' becomes high, the press force adjusting unit 107 advances the timing when the movement of at least one of the loading tray 101 and the pressing unit 104 is started.

In general, in the case where a print processing with a high printing ratio, such as printing of a photograph in a photographic mode, is performed to a sheet to be loaded on the loading tray, it becomes hard for the sheet loaded on the loading tray to slide on an adjacent sheet, and the sheet discharge onto the loading tray is liable to clog. Thus, in the case where the sheet having such characteristics is loaded, the occurrence of the poor sheet discharging is suppressed by advancing the timing when the press force of the pressing unit starts to be weakened.

It is preferable that as at least one of the temperature and the humidity becomes high, the press force adjusting unit 107 advances the timing when the movement of at least one of the loading tray 101 and the pressing unit 104 is started.

In general, since a sheet is liable to curl in a high temperature and high humidity environment, even in the case where precisely the same sheet or the same booklet is loaded on the loading tray 101, the loading height of the sheets is liable to become high as compared with that in a normal temperature and normal humidity environment. Thus, in the case where the sheet is loaded in the high temperature and high humidity environment, the occurrence of the poor sheet discharging is suppressed by advancing the timing when the press force of the pressing unit 104 starts to be weakened.

Besides, as at least one of the temperature and the humidity becomes low, the press force adjusting unit 107 can advance the timing when the movement of at least one of the loading tray 101 and the pressing unit 104 is started.

In general, in the low temperature and low humidity environment, the sheet is liable to become electrostatically charged. Thus, adjacent sheets among sheets loaded on the loading tray are attracted to each other, and as a result, the sheet transport resistance in the sheet discharge from the sheet post-processing device becomes high. In the state where the sheet transport resistance is high as stated above, when the sheet is pressed by further applying the press force of the pressing unit, there is a high possibility that poor sheet discharging occurs at the sheet discharge port of the sheet post-processing device. Thus, in the case where the sheet is loaded in the low temperature and low humidity environment, the occurrence of the poor sheet discharging can be suppressed by advancing the timing when the press force of the pressing unit starts to be weakened.

In addition, as the thickness of the sheet as the object of the specified processing becomes large, the press force adjusting unit 107 may advance the timing when the movement of at least one of the loading tray 101 and the pressing unit 104 is started. In general, in a thick sheet, as compared with a standard copy sheet, expansion after the simple bookbinding processing is performed is liable to become large. Thus, in the case where the thick sheet is loaded, the occurrence of the poor sheet discharging is suppressed by advancing the timing when the press force of the pressing unit 104 starts to be weakened.

Besides, in the embodiment, although the structure is made such that the press force adjusting unit 107 continuously moves at least one of the loading tray 101 and the pressing unit 104 according to the value of the loading information acquired by the loading information acquisition unit 106, no limitation is made to this. For example, when the value of the loading information acquired by the loading information acquisition unit 106 exceeds a specified threshold value, the press force adjusting unit 107 may first cause at least one of the loading tray 101 and the pressing unit 104 to start to move.

As stated above, the position adjustment of the loading tray or the pressing unit is made unnecessary to the loading amount (threshold value) in which there is no fear of occurrence of poor sheet discharging, and this can contribute to the reduction of the processing load of the whole apparatus.

Figure 6:
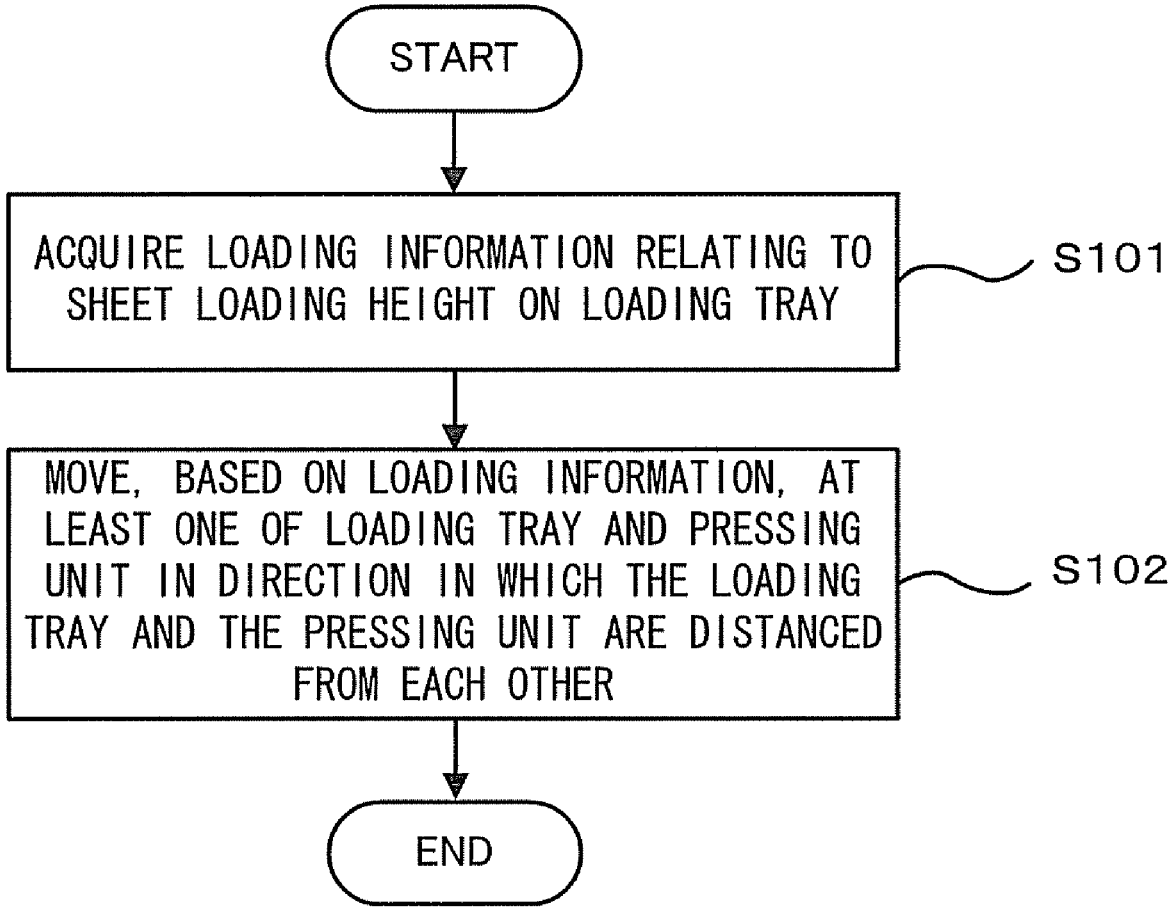
FIG. 6 is a flowchart for explaining a flow (sheet loading method) of processing in the sheet loading device of the embodiment.

FIG. 6 is a flowchart for explaining a flow (sheet loading method) of processing in the sheet loading device of the embodiment.

The loading information acquisition unit 106 acquires the loading information relating to the sheet loading height on the loading tray 101 on which the sheet subjected to the specified processing is loaded (S101).

The press force adjusting unit 107 moves, based on the loading information, at least one of the loading tray 101 and the pressing unit 104 to press from above the sheet loaded on the loading tray 101 in the direction in which the loading tray 101 and the pressing unit 104 are distanced from each other (S102).

Third Embodiment

Next, a third embodiment of the invention will be described.

This embodiment is a modified example of the second embodiment. Hereinafter, in this embodiment, a portion having the same function as a portion already explained in the second embodiment is denoted by the same reference numeral and its explanation will be omitted.

Figure 7:
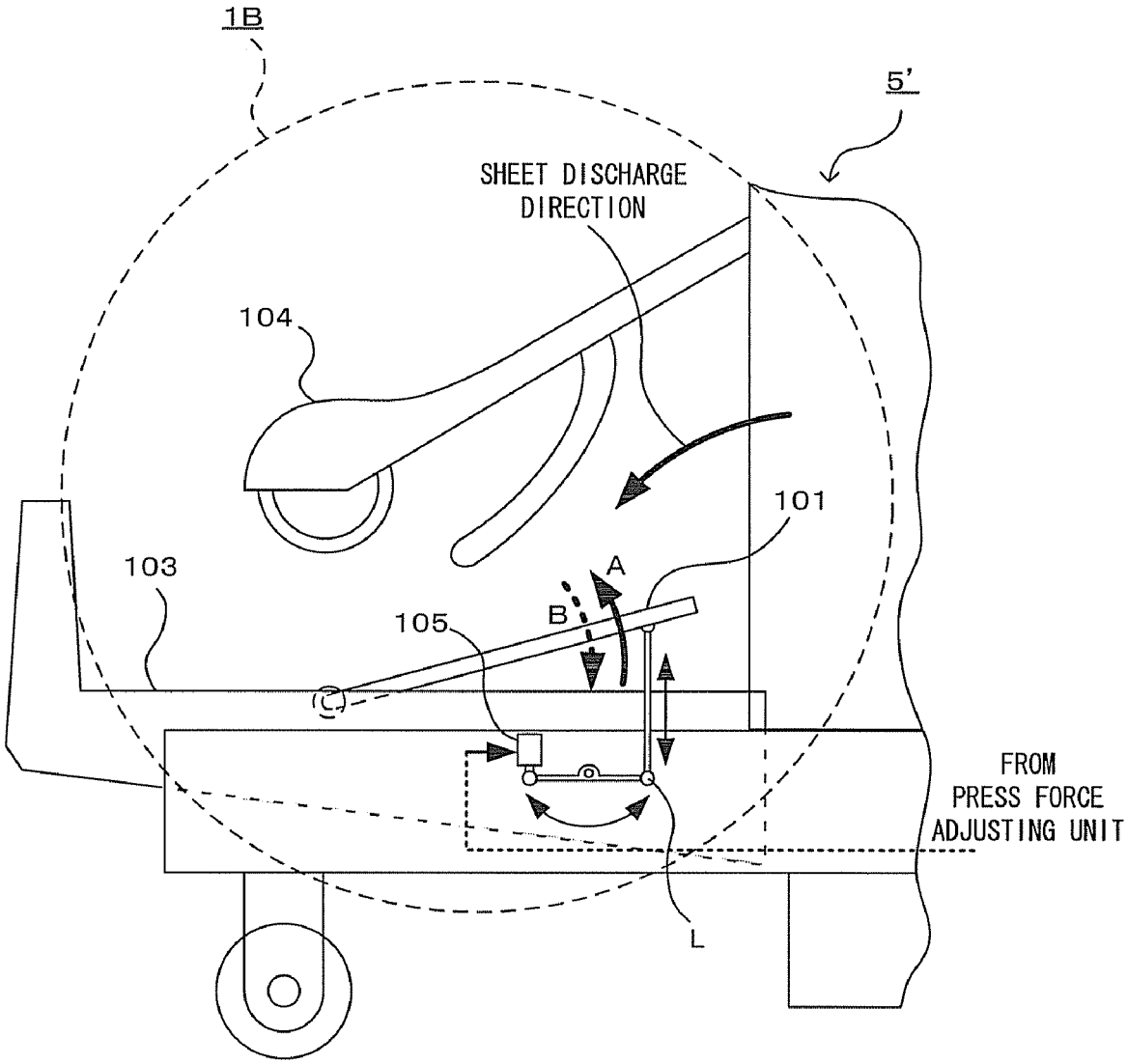
FIG. 7 is a view showing a detailed structure of a sheet loading device 1B of a third embodiment of the invention.

FIG. 7 is a view showing a detailed structure of a sheet loading device 1B of the third embodiment.

As shown in the drawing, the sheet loading device 1B of the embodiment includes a loading tray 101, a tray base 103, a pressing unit 104 and a solenoid 105.

In this embodiment, the tray base 103 and the loading tray 101 are different members, and the downstream side end of the loading tray 101 in a direction in which a sheet is transported onto the loading tray 101 is supported (axially supported) rotatably with respect to the tray base 103.

The drive force from the solenoid 105 is transmitted through a link mechanism L to the loading tray 101 rotatably supported as described above, and the loading tray moves in one of an arrow A direction and an arrow B direction in linkage with the operation of the solenoid 105.

Here, as an example, the mechanism is such that when the solenoid 105 is drawn, the inclined angle of the loading tray becomes gentle (the arrow B direction).

Besides, in this embodiment, when a value of loading information acquired by the loading information acquisition unit 106 exceeds a specified threshold value, the press force adjusting unit 107 drives the solenoid 105.

As stated above, the solenoid is used as the means for moving the loading tray, so that the sheet loading performance can be stabilized at low cost and by the simple structure.

Fourth Embodiment

Finally, a fourth embodiment of the invention will be described.

This embodiment is a modified example of the second embodiment. Hereinafter, in this embodiment, a portion having the same function as a portion already explained in the second embodiment is denoted by the same reference numeral and its explanation will be omitted.

Figure 8:
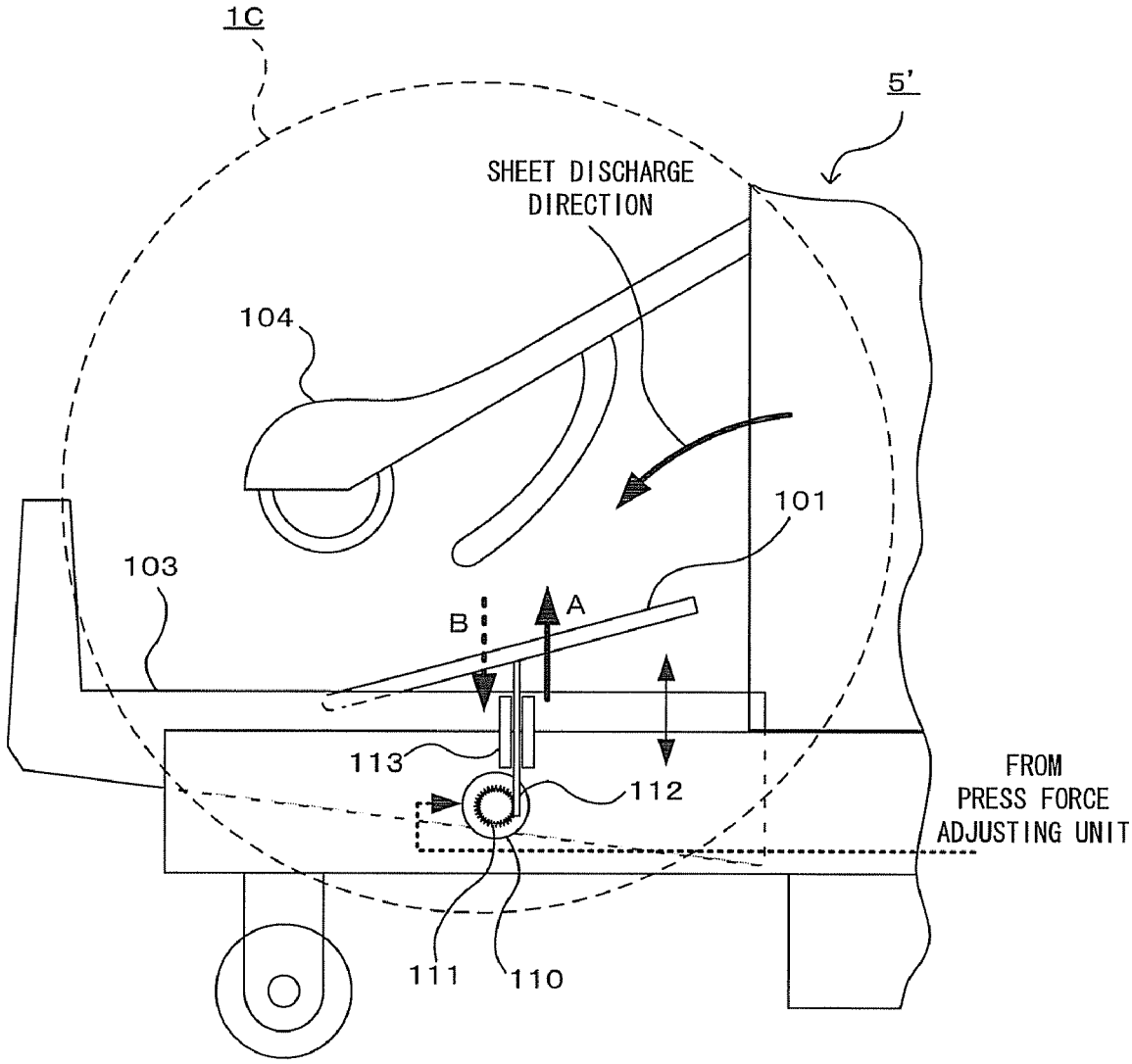
FIG. 8 is a view showing a detailed structure of a sheet loading device 1C of a fourth embodiment of the invention.
Figure 9:
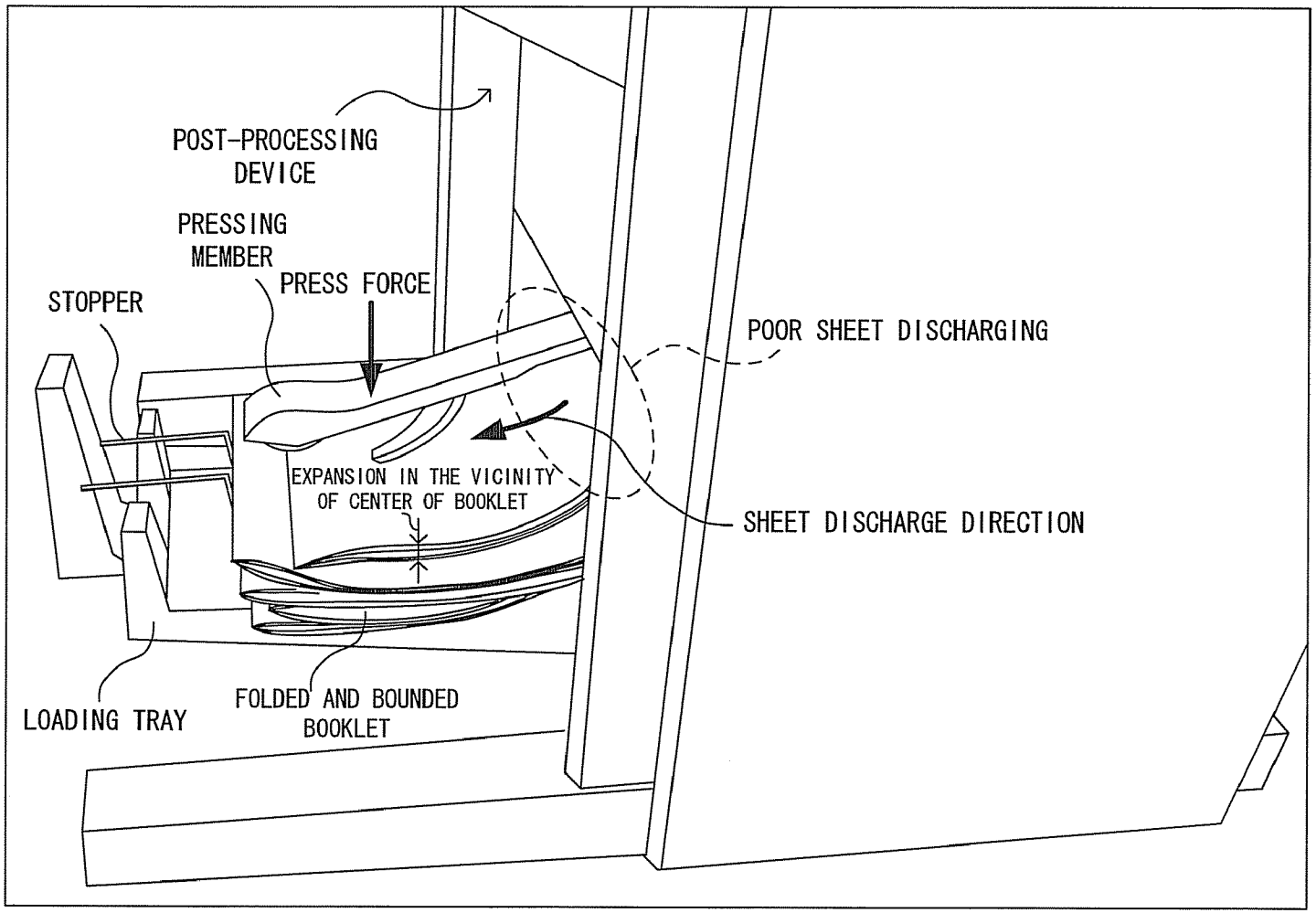
FIG. 9 is a view showing an example of poor sheet discharging caused by the increase of transport load due to the overlap of expansions of booklet center portions in a related art post-processing device.

FIG. 8 is a view showing a detailed structure of a sheet loading device 1C of the fourth embodiment.

As shown in the drawing, the sheet loading device 1B of the embodiment includes a loading tray 101, a tray base 103, a pressing unit 104, a motor 110, a pinion 111, a rack 112 and a guide member 113.

In the second embodiment, although the movement locus of the loading tray 101 is regulated by rotatably supporting (axially supporting) the end of the loading tray 101 to the tray base 103, in this embodiment, the loading tray 101 is guided by the guide member 113 between a first position close to the pressing unit 104 and a second position farther from the pressing unit 104 than the first position.

Incidentally, in the respective embodiments, although the structure has been exemplified in which the loading tray is lowered in proportion to the increase of the sheet loading amount on the loading tray, the embodiment of the invention is not limited to this. For example, it is needless to say that the structure can be made such that the pressing member to press the sheet upper surface on the loading tray is moved (lifted) in the direction of moving away from the loading tray in proportion to the increase of the sheet loading amount on the loading tray.

Of course, not only one of the loading tray 101 and the pressing unit 104 is moved so that both of them are distanced from each other, but also both of them may be moved in the direction in which both of them are distanced from each other.

Besides, in the embodiment, the structure has been exemplified in which based on the temperature and humidity, the thickness of a sheet, the surface roughness of a sheet, the printing ratio and the like, in the environment in which the poor sheet discharging is liable to occur, the timing when the pressing unit 104 and the loading tray 101 start to be moved away from each other is advanced, however, no limitation is made to this, and in addition to this, in the environment in which the poor sheet discharging is liable to occur, the distance provided between the pressing unit 104 and the loading tray 101 may be made large. By this, in the environment in which the transport resistance is liable to increase, the press force of the pressing unit 104 to the sheet upper surface is weakened, and the occurrence of the poor sheet discharging can be suppressed.

Incidentally, the respective steps in the processing of the sheet loading device according to the second to the fourth embodiments are realized by causing the CPU 801 to execute a loading sheet press force control program stored in the memory 802.

In the embodiment, although the description has been given to the case where the function to carry out the invention is previously recorded in the inside of the apparatus, no limitation is made to this, and the same function may be downloaded from a network to the apparatus, or the same function stored on a recording medium may be installed in the apparatus. The recording medium may have any form as long as the recording medium, such as a CD-ROM, can store a program and can be read by the apparatus. Besides, the function obtained by the previous installation or download may realize the function in cooperation with the OS (Operating System) in the inside of the apparatus.

Although the invention has been described in detail with reference to the specific mode, it would be apparent for one of ordinary skill in the art that various modifications and improvements can be made without departing from the sprit and scope of the invention.

As described above in detail, according to the invention, it is possible to provide the technique which can realize the stable loading performance irrespective of the state of the loading object loaded on the tray.

What is claimed is:

1. A sheet loading device comprising:

a loading information acquisition unit configured to acquire loading information relating to a surface roughness value of a sheet and a sheet loading height on a loading tray on which a sheet subjected to a specified processing is loaded;

a press force adjusting unit configured to move, based on the loading information, at least one of the loading tray and a pressing unit to press from above the sheet loaded on the loading tray in a direction in which the loading tray and the pressing unit are distanced from each other; and as the surface roughness value of the sheet as an object of the specified processing becomes large, the press force adjusting unit advances timing when movement of at least one of the loading tray and the pressing unit is started.

2. A sheet loading device comprising:

a loading information acquisition unit configured to acquire loading information relating to a printing ratio on a sheet and a sheet loading height on a loading tray on which a sheet subjected to a specified processing is loaded;

a press force adjusting unit configured to move, based on the loading information, at least one of the loading tray and a pressing unit to press from above the sheet loaded on the loading tray in a direction in which the loading tray and the pressing unit are distanced from each other;

the specified processing includes a print processing on a sheet; and as the printing ratio on the sheet subjected to the specified processing becomes high, the press force adjusting unit advances timing when movement of at least one of the loading tray and the pressing unit is started.

3. A sheet loading device comprising:

a loading information acquisition unit configured to acquire loading information relating to at least one of a temperature and humidity, and a sheet loading height on a loading tray on which a sheet subjected to a specified processing is loaded;

a press force adjusting unit configured to move, based on the loading information, at least one of the loading tray and a pressing unit to press from above the sheet loaded on the loading tray in a direction in which the loading tray and the pressing unit are distanced from each other; and as at least one of the temperature and the humidity becomes high, the press force adjusting unit advances timing when movement of at least one of the loading tray and the pressing unit is started.

4. A sheet loading device comprising:

a loading information acquisition unit configured to acquire loading information relating to at least one of a temperature and humidity, and a sheet loading height on a loading tray on which a sheet subjected to a specified processing is loaded;

a press force adjusting unit configured to move, based on the loading information, at least one of the loading tray and a pressing unit to press from above the sheet loaded on the loading tray in a direction in which the loading tray and the pressing unit are distanced from each other; and as at least one of the temperature and the humidity becomes low, the press force adjusting unit advances timing when movement of at least one of the loading tray and the pressing unit is started.

5. A sheet loading device comprising:

a loading information acquisition unit configured to acquire loading information relating to a thickness of a sheet and a sheet loading height on a loading tray on which a sheet subjected to a specified processing is loaded;

a press force adjusting unit configured to move, based on the loading information, at least one of the loading tray and a pressing unit to press from above the sheet loaded on the loading tray in a direction in which the loading tray and the pressing unit are distanced from each other; and as the thickness of the sheet as an object of the specified processing becomes large, the press force adjusting unit advances timing when movement of at least one of the loading tray and the pressing unit is started.

6. A method for loading a sheet on a loading tray, comprising:

loading a sheet on a loading tray;

pressing at least one of the loading tray and the sheet on the loading tray down by a pressing unit;

acquiring loading information comprising a surface roughness value of the sheet and a sheet loading height on the loading tray;

moving, based on the loading information, at least one of the loading tray and the pressing unit in a direction in which the loading tray and the pressing unit are moving away from each other, and advancing timing when movement of at least one of the loading tray and the pressing unit is started, as the surface roughness value of the sheet becomes large.

7. A method for loading a sheet on a loading tray, comprising:

loading a sheet on a loading tray;

pressing at least one of the loading tray and the sheet on the loading tray down by a pressing unit;

acquiring loading information comprising a printing ratio on the sheet and a sheet loading height on the loading tray;

moving, based on the loading information, at least one of the loading tray and the pressing unit in a direction in which the loading tray and the pressing unit are moving away from each other, and advancing timing when movement of at least one of the loading tray and the pressing unit is started, as the printing ratio on the sheet becomes high.

8. A method for loading a sheet on a loading tray, comprising:

loading a sheet on a loading tray;

pressing at least one of the loading tray and the sheet on the loading tray down by a pressing unit;

acquiring loading information comprising at least one of a temperature and humidity, and a sheet loading height on the loading tray;

moving, based on the loading information, at least one of the loading tray and the pressing unit in a direction in which the loading tray and the pressing unit are moving away from each other, and advancing timing when movement of at least one of the loading tray and the pressing unit is started, as at least one of the temperature and the humidity becomes high.

9. A method for loading a sheet on a loading tray, comprising:

loading a sheet on a loading tray;

pressing at least one of the loading tray and the sheet on the loading tray down by a pressing unit;

acquiring loading information comprising at least one of a temperature and humidity, and a sheet loading height on the loading tray;

moving, based on the loading information, at least one of the loading tray and the pressing unit in a direction in which the loading tray and the pressing unit are moving away from each other, and advancing timing when movement of at least one of the loading tray and the pressing unit is started, as at least one of the temperature and the humidity becomes low.

10. A method for loading a sheet on a loading tray, comprising:

loading a sheet on a loading tray;

pressing at least one of the loading tray and the sheet on the loading tray down by a pressing unit;

acquiring loading information comprising a thickness of the sheet and a sheet loading height on the loading tray;

moving, based on the loading information, at least one of the loading tray and the pressing unit in a direction in which the loading tray and the pressing unit are moving away from each other, and advancing timing when movement of at least one of the loading tray and the pressing unit is started, as the thickness of the sheet becomes large.

* * * * *